US008087801B2

(12) United States Patent
Tseng

(10) Patent No.: US 8,087,801 B2
(45) Date of Patent: Jan. 3, 2012

(54) LIGHT-EMITTING DEVICE

(76) Inventor: Shen-Ko Tseng, Taipei (TW)

( * ) Notice: Subject to any disclaimer, the term of this patent is extended or adjusted under 35 U.S.C. 154(b) by 405 days.

(21) Appl. No.: 11/774,323

(22) Filed: Jul. 6, 2007

(65) Prior Publication Data

US 2009/0009990 A1 Jan. 8, 2009

(51) Int. Cl.
*F21S 4/00* (2006.01)
*F21V 21/08* (2006.01)

(52) U.S. Cl. ..... 362/249.05; 362/103; 362/105; 362/106

(58) Field of Classification Search ..... 362/103, 362/105, 106, 249.05
See application file for complete search history.

(56) References Cited

U.S. PATENT DOCUMENTS 5,457,900 A * 10/1995 Roy et al. ..... 36/137
7,156,535 B1 * 1/2007 Deutsch et al. ..... 362/103
2003/0070324 A1 * 4/2003 Nelson ..... 36/137
2005/0011737 A1 * 1/2005 Wong et al. ..... 200/61

* cited by examiner

*Primary Examiner* — Diane Lee
*Assistant Examiner* — Sean Gramling

(57) ABSTRACT

The invention provides a light-emitting device, which includes a water-proof enclosure, a motion-actuated switch, a controller, a memory unit, a light-emitting array, a driving unit, and a battery. The motion-actuated switch is capable of generating a triggering signal if an external force presses on it. Furthermore, when the controller is under the start condition, it can selectively generate a lighting signal according to the triggering signal. The memory unit is applied for storing a plurality of default patterns. The light-emitting array includes a plurality of light-emitting diodes. The driving unit is capable of selecting one of the default patterns according to the lighting signal in a pre-determined way, and driving the light-emitting array lighting based on the default pattern. Particularly, the pre-determined way is in a proper sequence.

8 Claims, 7 Drawing Sheets

LIGHT-EMITTING DEVICE

BACKGROUND OF THE INVENTION

1. Field of the Invention

The present invention relates generally to a light-emitting device and, more particularly, to a light-emitting device which includes a light-emitting array.

2. Description of the Prior Art

Poor illumination at night is a setback to night activities. Problems regarding difficult identification and safety may occur. People who go jogging or cycling at night may be hit by cars due to insufficient illumination. Sports playing in open places may have to be stopped at night if street lamps do not provide enough illumination. It is, therefore, necessary to find means to enhance the safety and ensure the smooth-going of night activities.

Footwear with flashing device is available on the market for safety reasons described above. Such footwear typically includes at least one light source, such as light emitting diodes (LEDs); a source of power, such as a battery; and a switch to connect the battery to the light sources for the purpose of illumination.

In addition, the switch could be a simple manual switch as disclosed, for example, in U.S. Pat. No. 4,158,922. The switch could be a mercury switch in which a ball of mercury runs back and forth along a tube between a pair of electrical contacts during motion of the footwear, as disclosed in U.S. Pat. No. 4,848,009. The switch can be a pressure-responsive switch which is turned on and off in response to application of the wearer s weight on the switch as disclosed, for example, in U.S. Pat. No. 5,285,586. The switch can also be a spring switch in which a cantilevered spring in the form of a coil that oscillates back and forth to make and break contact with an electrical terminal as, for example, shown in U.S. Pat. No. 5,408,764.

Moreover, to provide lighting in an energy-saving way, it is desirable to make the lights flash on and off, rather than having them continuously illuminated while the switch is closed. Furthermore, to prevent the aforesaid device from water and dust, so as to extend the lifetime of such device, the system-in-package design that includes the battery, the responsive switch, and the control circuit of the LEDs is also desired.

SUMMARY OF THE INVENTION

Accordingly, the aspect of the present invention is to provide a light-emitting device which can generate an attractive pattern. Particularly, the light-emitting device of the present invention is capable of being properly turned on and off to provide lighting in an energy-saving way.

According to a preferred embodiment of the invention, the light-emitting device includes a water-proof enclosure, a motion-actuated switch, a controller, a memory unit, a 2D light-emitting array, a driving unit, and a battery. Furthermore, the motion-actuated switch, the controller, the memory unit, the driving unit, and the battery are disposed in the water-proof enclosure.

The motion-actuated switch is capable of generating a triggering signal according to an external force applied on it. Furthermore, when the controller is under an active condition, it is capable of selectively generating a lighting signal according to the triggering signal. The memory unit is used for storing a plurality of default patterns. Furthermore, the 2D light-emitting array is disposed on the outside of the water-proof enclosure, which includes a plurality of light-emitting diodes. The driving unit is electrically connected to the controller, the memory unit, and the 2D light-emitting array. The driving unit selects one of the plurality of default patterns in a pre-determined way according to the lighting signal, and the driving unit drives the 2D light-emitting array according to the default pattern, wherein the pre-determined way is a sequential way. The battery is used for supplying said light-emitting device with electrical power.

According to another preferred embodiment of the invention, the light-emitting device includes an object and a light-emitting electronic device disposed on the object. Furthermore, the light-emitting electronic device includes a water-proof enclosure, a motion-actuated switch, a controller, a memory unit, a 2D light-emitting array, a driving unit, and a battery. Furthermore, the motion-actuated switch, the controller, the memory unit, the driving unit, and the battery are disposed or mounted in the water-proof enclosure respectively.

The motion-actuated switch is capable of generating a triggering signal according to an external force brought to the motion-actuated switch. Moreover, when the controller is under a switch-on situation, it is capable of selectively generating a lighting signal according to the triggering signal. On the contrary, when the controller does not receive the triggering signal within a pre-determined period, the controller enters a switch-off situation, and no longer generates the lighting signal. The memory unit is applied for storing a plurality of default patterns. The 2D light-emitting array is disposed out the water-proof enclosure, and the 2D light-emitting array includes a plurality of light-emitting diodes. The driving unit is electrically connected to the controller, the memory unit, and the 2D light-emitting array, and the driving unit is capable of selecting one of the plurality of default patterns in a pre-determined way according to the lighting signal, and driving the 2D light-emitting array according to the default pattern. Furthermore, the pre-determined way is a sequential way. The battery is used for supplying said light-emitting device with electrical power; whereas the control switch is used for resetting the controller from the inactive condition to the active condition.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 1A:
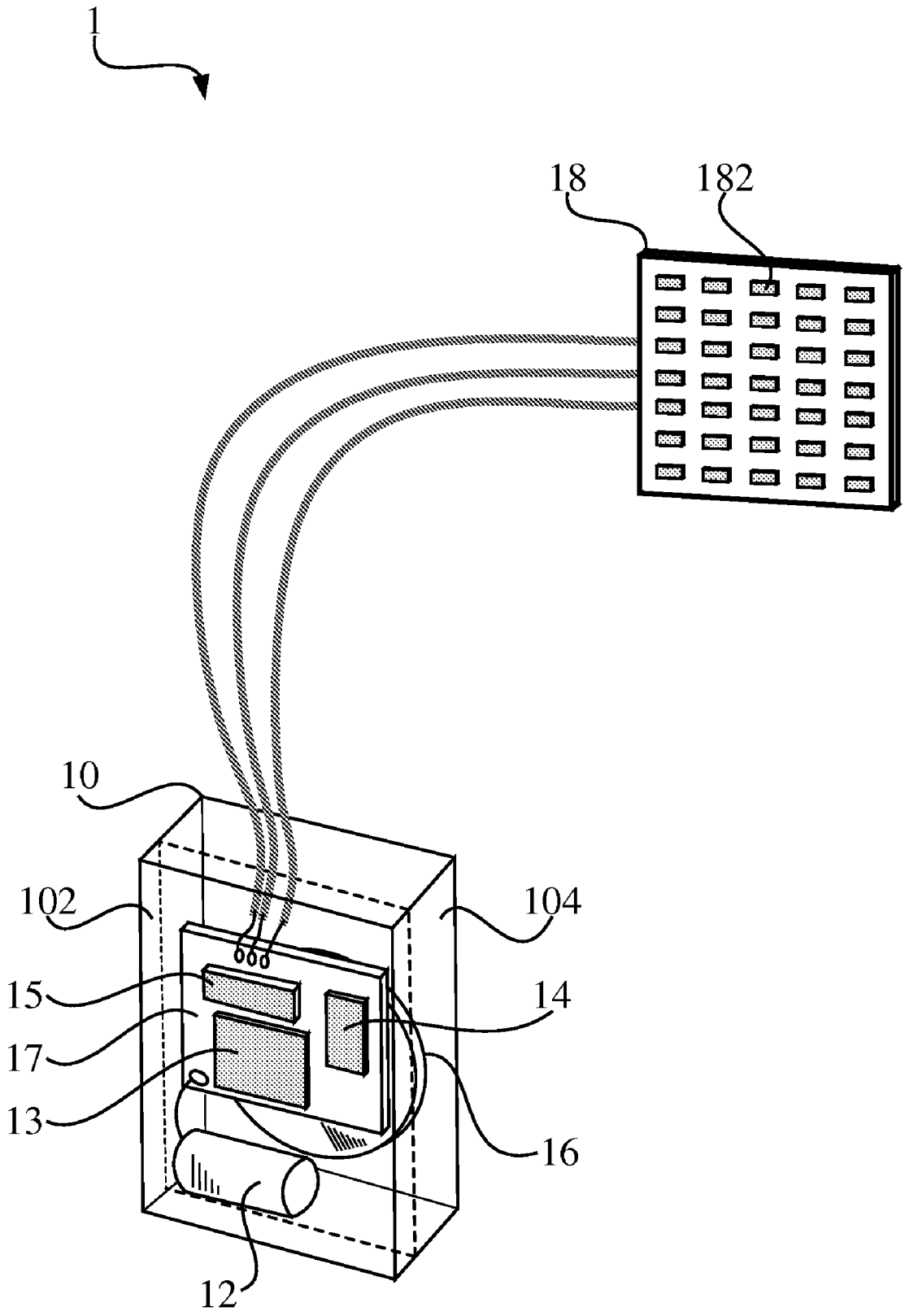
FIG. 1A illustrates a light-emitting device of an embodiment of the invention.
Figure 1B:
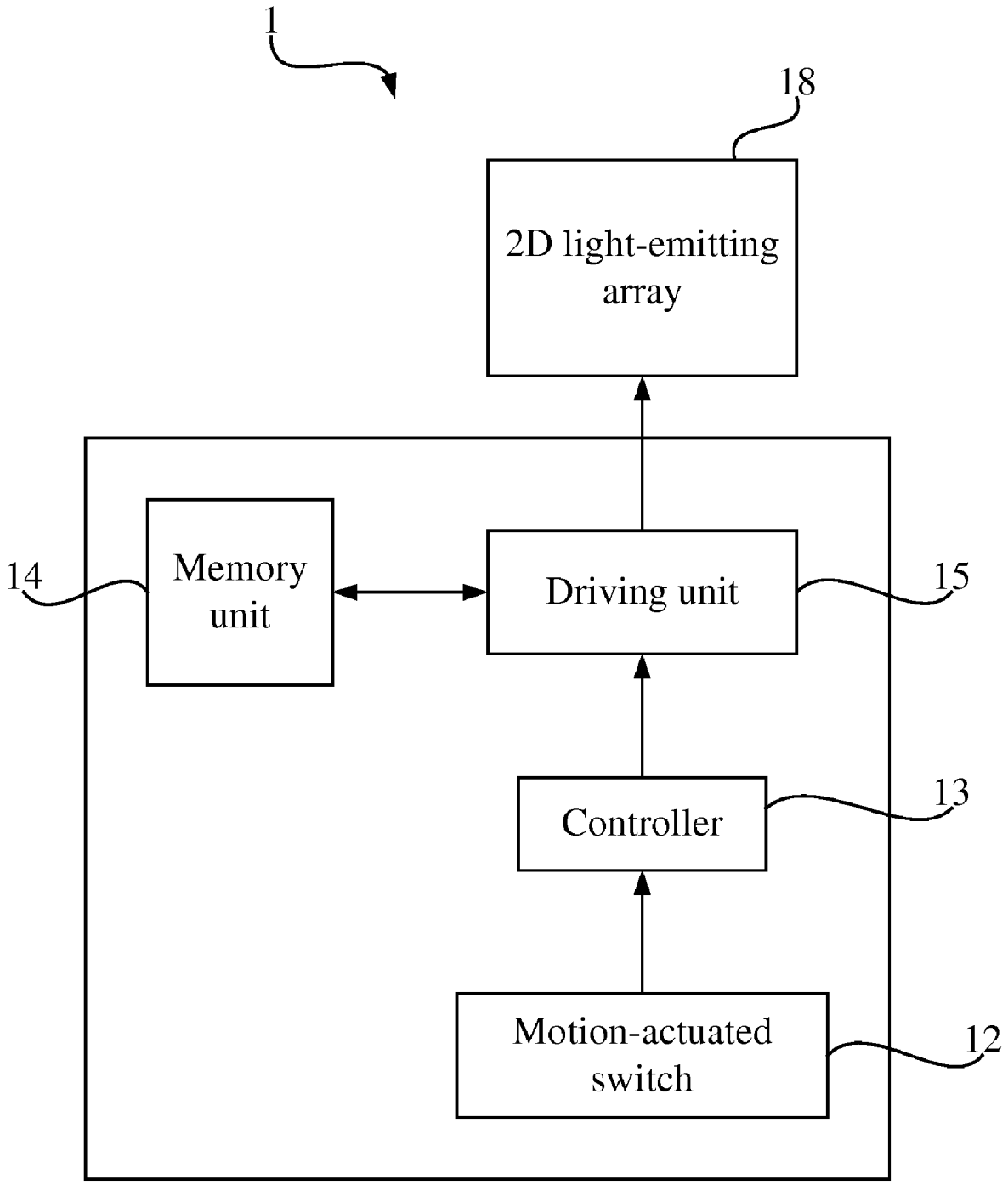
FIG. 1B is a function block of the light-emitting device of FIG. 1A.

Please refer to FIG. 1A and FIG. 1B, FIG. 1A illustrates a light-emitting device of an embodiment of the invention; and FIG. 1B is a function block of the light-emitting device of FIG. 1A. In the embodiment, the light-emitting device 1 includes a water-proof enclosure 10, a motion-actuated switch 12, a controller 13, a memory unit 14, a driving unit 15, a battery 16, and a 2D light-emitting array 18.

In the embodiment, the motion-actuated switch 12, the controller 13, the memory unit 14, the driving unit 15, and the battery 16 are disposed in the water-proof enclosure 10. The 2D light-emitting array 18 includes a plurality of light-emitting diodes 182, and the 2D light-emitting array 18 are disposed on the outside of the water-proof enclosure 10. Moreover, the controller 13, the memory unit 14, and the driving unit 15 are disposed on a circuit 17. Please note that, in practice, the above-mentioned controller 13, memory unit 14, and driving unit 15 can also be disposed and mounted in the water-proof enclosure 10 without the circuit 17.

The water-proof enclosure 10 can be formed by injection molding of resin or plastic. As shown in FIG. 1A, in the embodiment, the water-proof enclosure 10 includes a plastic container 104 and an upper plastic cover 102 bonded to the plastic container 104. In practice, the upper plastic cover 102 is fused to the circumference of the plastic container 104 by supersonic wave or laser.

The motion-actuated switch 12 can generate a triggering signal according to an external force applied on it. In practice, the external force can be, but not limited to the force caused by hitting, shaking, fling, and beating. For example, when a user shakes the water-proof enclosure 10, the motion-actuated switch 12 can generate the triggering signal according to the external force caused by shaking.

Additionally, when the controller 13 is under an active condition, the controller 13 can selectively generate a lighting signal according to the triggering signal. In practice, when the controller 13 does not receive the triggering signal within a pre-determined period, such as 15 seconds, 30 seconds, 1 minute, 5 minutes, the controller 13 will enter an inactive condition, and no longer generates the lighting signal. Therefore, the light-emitting device 1 can avoid energy consumption in idle time, and reach the objectives of energy saving and lifetime extension of the devices of the invention.

The memory unit 14 can store a plurality of default patterns, such as letters from A to Z; the numbers from 0 to 9; the symbols, such as . , ; , =, >; and other suitable patterns. Furthermore, the default patterns of the invention can be dynamic patterns, such as flashing characters or numbers, so as to provide an attractive effect. The battery 16 is used for supplying the light-emitting device 1 with electrical power, for instance, the electrical power needed for the 2D light-emitting array 18 to light, the electrical power needed for the motion-actuated switch 12 to generate the triggering signal, and the electrical power needed for the controller 13 to generate the lighting signal.

The driving unit 15 is electrically connected to the controller 13, the memory unit 14, and the 2D light-emitting array 18 respectively. The driving unit 15 can select a first default pattern from the plurality of default patterns in the memory unit 14 in a pre-determined way, such as a sequential way, according to the lighting signal, and drive the 2D light-emitting array 18 according to the first default pattern.

Please note that the above-mentioned term sequential way refers to the way the driving unit 15 selects the first default pattern according to the storing sequence or other sequences of the default patterns. For example, when the plurality of default patterns are the letters from A to Z, the driving unit 15 can selects the first default pattern according to the sequence from A to Z, the sequence from Z to A, or other sequences. For another example, when the plurality of default patterns are the numbers from 0 to 9, the driving unit 15 can select the first default pattern according to the sequence from 0 to 9; the sequence of odd numbers 1, 3, 5, 7, and 9; the sequence of even numbers 2, 4, 6, and 8; the sequence from 9 to 0; or other sequences.

In practice, when the plurality of default patterns are the patterns of the letters from A to Z, the driving unit can drive the 2D light-emitting array lighting the patterns from A to Z after it receives the lighting signal.

In practice, when the plurality of default patterns are the patterns of the letters from A to Z, the driving unit can drive the 2D light-emitting array lighting the pattern of letter A after it receives a first lighting signal, and drive the 2D light-emitting array lighting the pattern of letter B after it receives a second lighting signal, and drive the 2D light-emitting array lighting the pattern of letter C after it receives a third lighting signal. In other words, when the driving unit receives the 26th lighting signal, it can drive the 2D light-emitting array lighting the pattern of letter Z. Furthermore, when the driving unit receives the 27th lighting signal, it can drive the 2D light-emitting array lighting the pattern of letter A again. Furthermore, when the controller enters the inactive condition from the active condition and further enters the active condition, it can re-generate the lighting signal, and the driving unit can re-select the default pattern and then drives the 2D light-emitting array lighting (at this time, the 2D light-emitting array can light from the letter A or from the letter next to the last letter lighted in the active condition).

In practice, the light-emitting diode of the 2D light-emitting array of the invention can be a red light-emitting diode, a blue light-emitting diode, a green light-emitting diode, a yellow light-emitting diode, or other suitable light-emitting diodes. Furthermore, the 2D light-emitting array can optionally include light-emitting diodes with different colors, and the light-emitting diodes can be optionally arranged to form the 2D light-emitting array in different sizes.

Figure 2A:
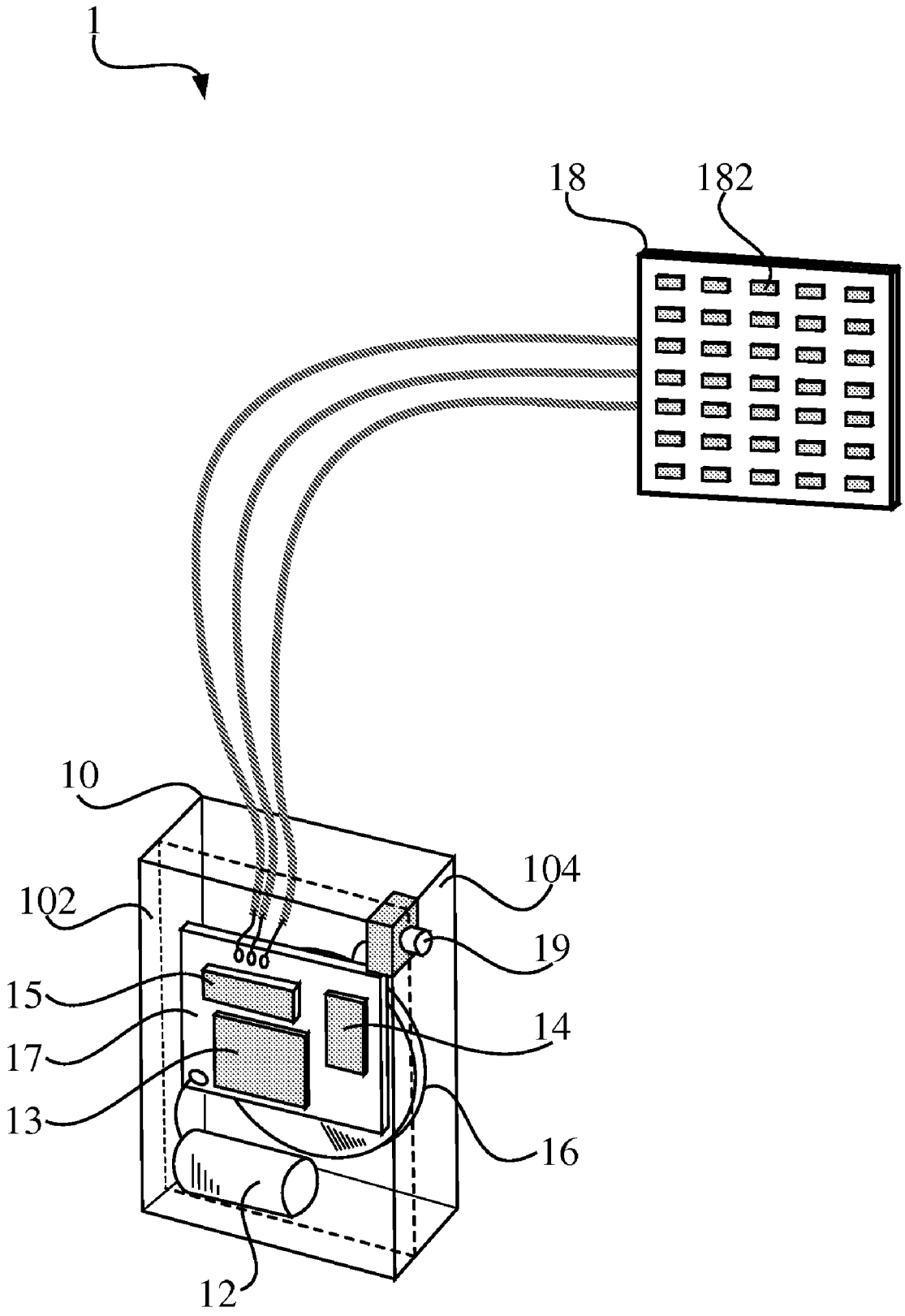
FIG. 2A illustrates a light-emitting device of an embodiment of the invention.
Figure 2B:
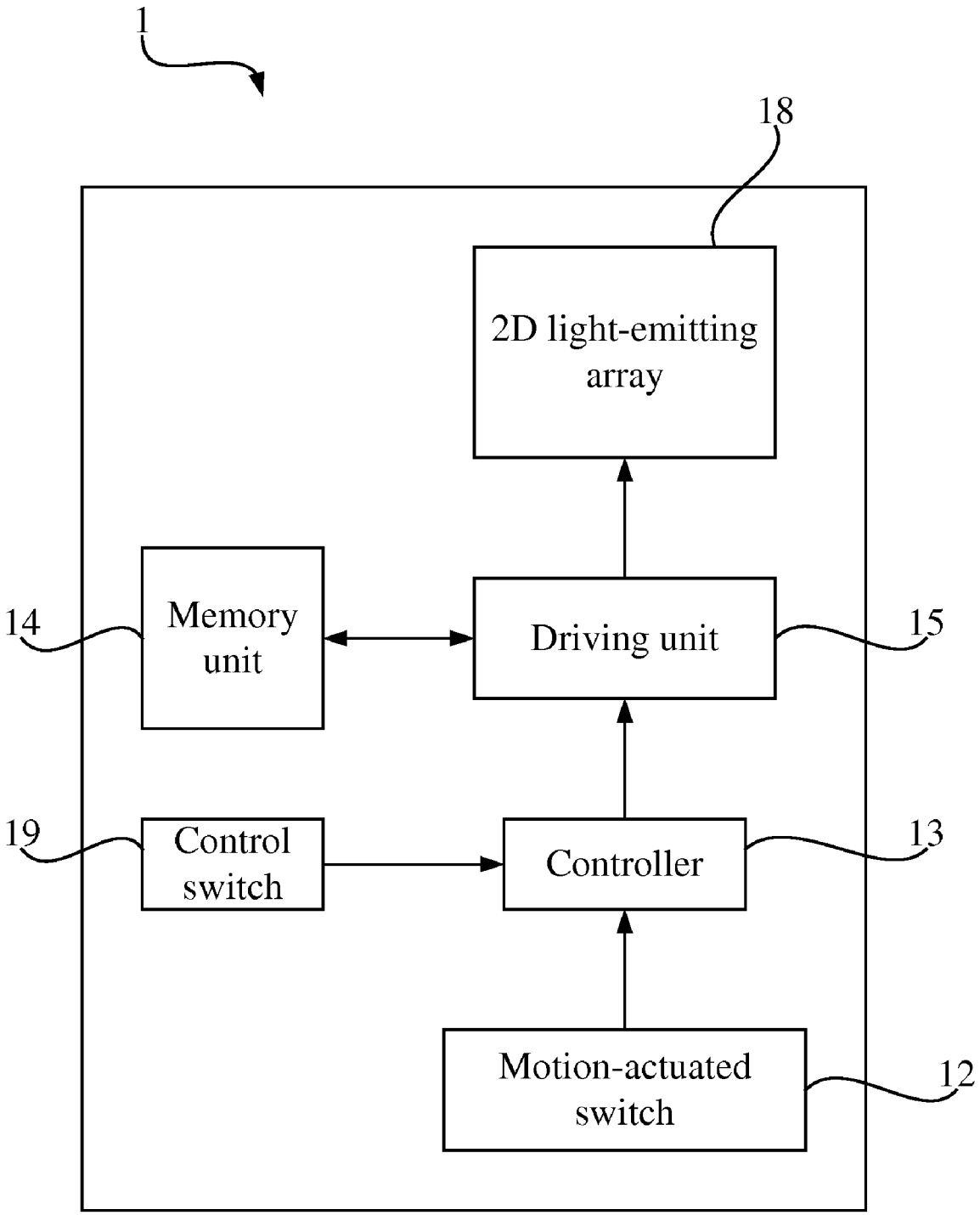
FIG. 2B is a function block of the light-emitting device of FIG. 2A.

Please refer to FIG. 2A and FIG. 2B, FIG. 2A illustrates a light-emitting device of an embodiment of the invention; and FIG. 2B is a function block of the light-emitting device of FIG. 2A. In the embodiment, the light-emitting device 1 includes the above-mentioned water-proof enclosure 10, motion-actuated switch 12, controller 13, memory unit 14, driving unit 15, battery 16, and 2D light-emitting array 18. Additionally, the light-emitting device 1 of the embodiment further includes a control switch 19, which is mounted on the water-proof enclosure 10 and electrically connected to the controller 13. The control switch 19 can be used by a user to press and reset the controller 13 from an inactive condition to an active condition, or from the active condition to the inactive condition.

Figure 2C:
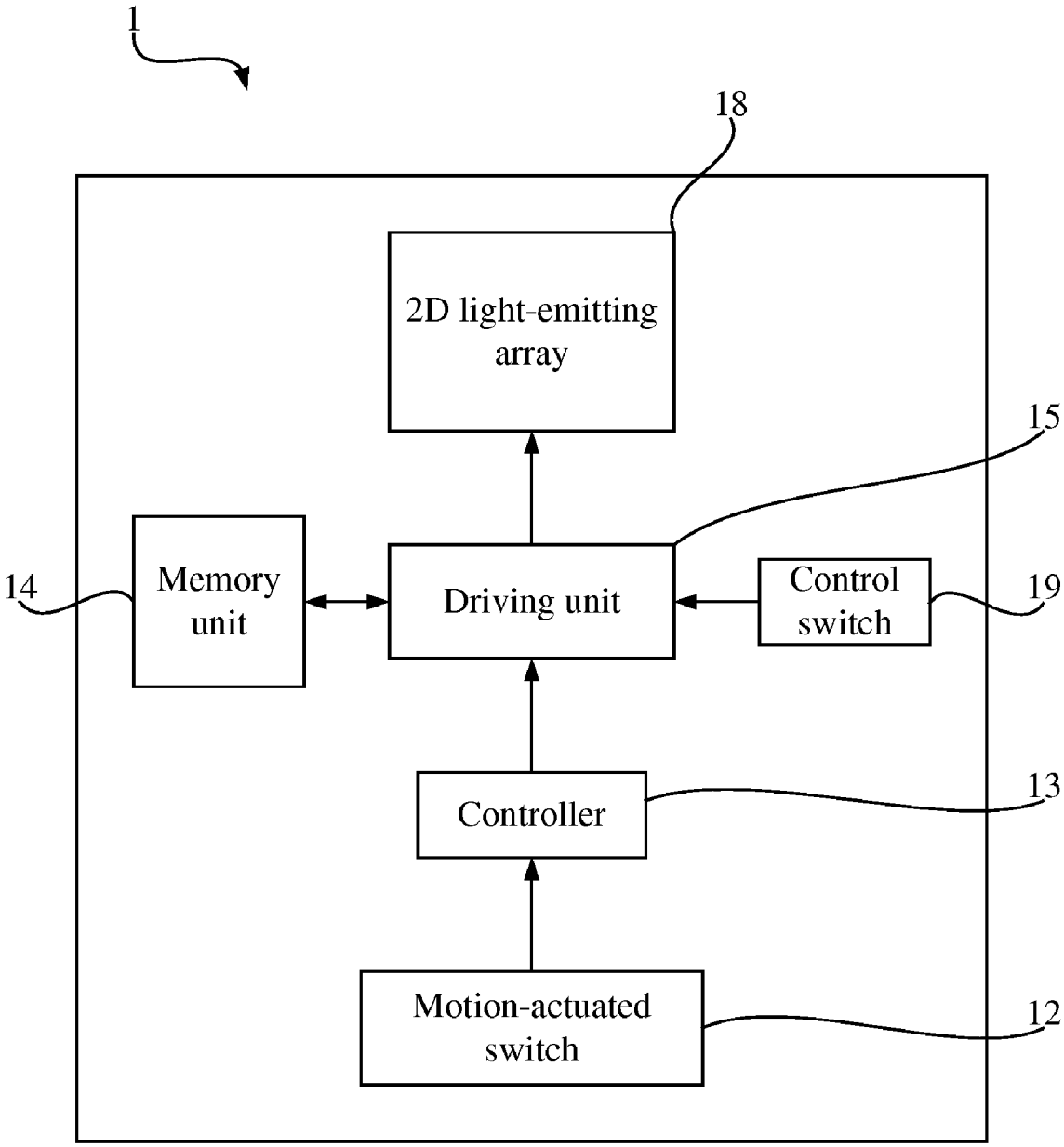
FIG. 2C is a function block of the light-emitting device of an embodiment of the invention.

Please further refer to FIG. 2C, which shows a function block of a light-emitting device of another embodiment of the invention. In the embodiment, to reach the objectives of energy saving and lifetime extension of the devices of the invention, when the driving unit does not receive the lighting signal within a pre-determined period, it will stop receiving the lighting signal and stop driving the 2D light-emitting array lighting. When this happens, the control switch is not electrically connected to the controller, but the driving unit, for resetting the driving unit to receive the lighting signal, or the control switch can also control the driving unit against receiving the lighting signal.

Additionally, in the embodiment, when the control switch resets the driving unit to re-receive the lighting signal, the driving unit can select a second default pattern from the plurality of default patterns stored in the memory unit, and drive the 2D light-emitting array lighting based on the second default pattern. Moreover, when the control switch controls the driving unit against receiving the lighting signal, the driving unit can select a third default pattern from the plurality of default patterns stored in the memory unit, and drive the 2D light-emitting array lighting based on the third default pattern.

In practice, the control switch can be disposed on the outside of the water-proof enclosure and be wrapped up by a water-proof material. Moreover, the control switch can be triggered by other ways, which can be, but not limited to sensing the change of lights, the vibration, the sounds, etc.

In practice, the memory unit and the driving unit of the invention of the invention can be disposed on the outside of the water-proof enclosure. For example, the memory unit and the driving unit can be disposed on a circuit with the 2D light-emitting array, and be further wrapped up by water-proof material.

According to a preferred embodiment, the light-emitting device of the invention includes an object and a light-emitting electronic device disposed on the object. The light-emitting electronic device includes a water-proof enclosure, a motion-actuated switch, a controller, a memory unit, a 2D light-emitting array, a driving unit, and a battery. Furthermore, the motion-actuated switch, the controller, the memory unit, the driving unit, and the battery are disposed or mounted in the water-proof enclosure respectively.

The motion-actuated switch is capable of generating a triggering signal according to an external force brought to the motion-actuated switch. Moreover, when the controller is under an active condition, it is capable of selectively generating a lighting signal according to the triggering signal. On the contrary, when the controller does not receive the triggering signal within a pre-determined period, the controller enters an inactive condition, and stops generating the lighting signal. The memory unit is applied for storing a plurality of default patterns. The 2D light-emitting array is disposed on the outside of the water-proof enclosure, and the 2D light-emitting array includes a plurality of light-emitting diodes. The driving unit is electrically connected to the controller, the memory unit, and the 2D light-emitting array, and the driving unit is capable of selecting one of the plurality of default patterns in a pre-determined way according to the lighting signal, and driving the 2D light-emitting array according to the default pattern. Furthermore, the pre-determined way is a sequential way. The battery is used to supply the light-emitting device with electrical power; whereas the control switch is used for resetting the controller from the inactive condition to the active condition.

Additionally, the above-mentioned object can be installed in, but not limited to, shoes, such as casual shoes, sports shoes, and leather shoes; a garment, such as a jacket, a vest, a rain coat, and sportswear; an accessory, such as a handbag, a rucksack, a belt, a watch, and a cap.

Figure 3:
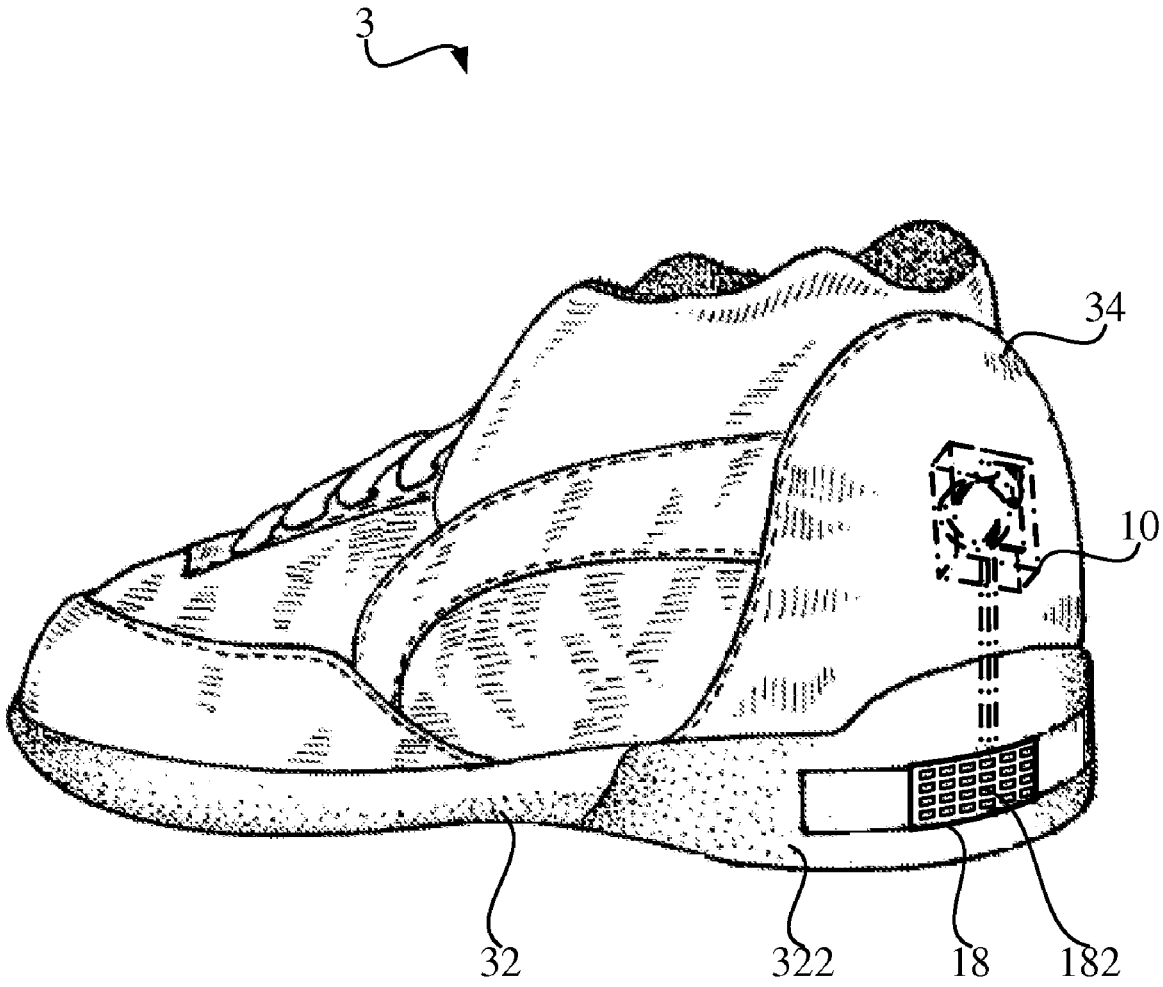
FIG. 3 illustrates the light-emitting device of the invention disposed in footwear.

Please refer to FIG. 3, which shows a schematic diagram of the light-emitting device disposed on a shoe 3. As shown in FIG. 3, the 2D light-emitting array 18 is disposed in a heel portion 322 of the sole 32, whereas the water-proof enclosure 10 of the present invention is disposed in a back portion 34. When a wearer walks or runs, the motion-actuated switch can trigger the controller, and the controller can control the driving unit to select one of the default patterns, and further drives the 2D light-emitting array 18 lighting/flashing based on the default pattern. Furthermore, the lighting or flashing of the 2D light-emitting array 18 provides strong and safe illumination when the wearer walks or runs at night.

Figure 4:
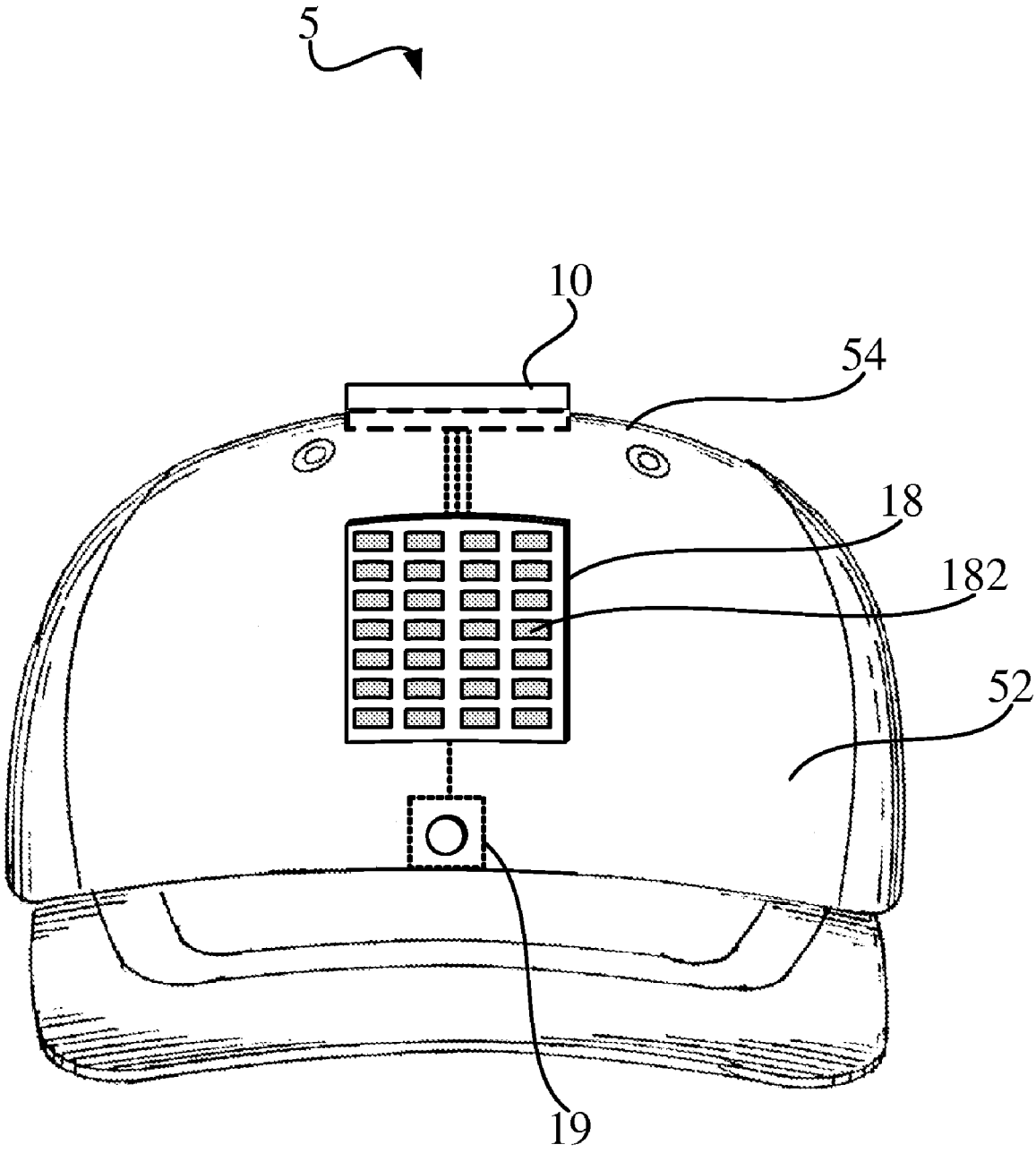
FIG. 4 is a front view of the light-emitting device of the invention disposed in a hat.

Please refer to FIG. 4, which shows a schematic diagram of the circuit device disposed on a cap 5. As shown in FIG. 4, the 2D light-emitting array 18 and the control switch 19 are disposed on the front portion 52 of the cap 5, whereas the water-proof enclosure 10 and the other devices therein are disposed on the top portion 54 of the cap 5. When a wearer walks or runs, the motion-actuated switch can trigger the controller, and the controller can control the driving unit to select one of the default patterns, and further drives the 2D light-emitting array 18 lighting/flashing based on the default pattern. Furthermore, as described above, the wearer can press the control switch 19 to reset the controller from the inactive condition to the active condition or from the active condition to the inactive condition. Moreover, the user can press the control switch 19 to reset the driving unit in order to either receive the lighting signal or not to receive the lighting signal.

Obviously, when the 2D light-emitting array of the invention light up, an attractive pattern can be generated. Additionally, the light-emitting device of the present invention is compact, energy saving, and may be applied on many different objects and articles to provide strong illumination for night activities.

Although the present invention has been illustrated and described with reference to the preferred embodiment thereof, it should be understood that it is in no way limited to the details of such embodiment but is capable of numerous modifications within the scope of the appended claims.

What is claimed is:

1. A light-emitting device comprising:

a water-proof enclosure;

a motion-actuated switch, disposed in the water-proof enclosure, for generating a triggering signal according to an external force;

a controller disposed in the water-proof enclosure, the controller generating a lighting signal according to the triggering signal when the controller is under an active condition, and the controller entering an inactive condition when the controller does not receive the triggering signal within a pre-determined period, wherein during the inactive condition, the controller stops generating the lighting signal even receiving the triggering signal generated by the motion-actuated switch, the controller is not able to be switched to the active condition in accordance with the triggering signal;

an active switch, only capable of resetting the controller from the inactive condition to the active condition;

a memory unit, disposed in the water-proof enclosure, for storing a plurality of default patterns;

a 2D light-emitting array having at least three columns and three rows, disposed on the outside of the water-proof enclosure and comprising a plurality of light-emitting diodes;

a driving unit, disposed in the water-proof enclosure, the driving unit being electrically connected to the controller, the memory unit, and the 2D light-emitting array, the driving unit selecting one of the plurality of default patterns in a pre-determined way according to the lighting signal from the controller, and the driving unit driving the 2D light-emitting array according to the selected default pattern, wherein the pre-determined way is a sequential way; and a battery, mounted in the water-proof enclosure, for supplying said light-emitting device with electrical power.

2. The light-emitting device of claim 1, wherein the plurality of default patterns comprises letters from A to Z.

3. The light-emitting device of claim 1, wherein each of the light-emitting diode is selected from a group consisting of: a red light-emitting diode, a blue light-emitting diode, a green light-emitting diode, and a yellow light-emitting diode.

4. The light-emitting device of claim 1, wherein the water-proof enclosure is formed of resin or plastic.

5. The light-emitting device of claim 1, wherein the water-proof enclosure comprises a plastic container and an upper plastic cover bonded to the plastic container, and the upper plastic cover being fused to the plastic container.

6. The light-emitting device of claim 5, wherein the upper plastic cover and the circumference of the plastic container are fused together.

7. A light-emitting device comprising:

an object; and a light-emitting electronic device disposed on the object, the light-emitting electronic device comprising:

a water-proof enclosure;

a motion-actuated switch, disposed in the water-proof enclosure, for generating a triggering signal according to an external force;

a controller disposed in the water-proof enclosure, the controller generating a lighting signal according to the triggering signal when the controller is under a active condition, wherein the controller from the active condition enters into an inactive condition when the controller does not receive the triggering signal within a pre-determined period, wherein during the inactive condition, the controller stops generating the lighting signal even receiving the triggering signal generated by the motion-actuated switch, the controller is not able to be switched to the active condition in accordance with the triggering signal;

a memory unit, disposed in the water-proof enclosure, for storing a plurality of default patterns;

a 2D light-emitting array having at least three columns and three rows, disposed on the outside of the water-proof enclosure, and the 2D light-emitting array comprising a plurality of light-emitting diodes;

a driving unit, disposed in the water-proof enclosure, the driving unit being electrically connected to the controller, the memory unit, and the 2D light-emitting array, and the driving unit selecting one of the plurality of default patterns in a pre-determined way according to the lighting signal, and the driving unit driving the 2D light-emitting array according to the selected default pattern, wherein the pre-determined way is a sequential way;

a battery, mounted in the water-proof enclosure, for supplying said light-emitting device with electrical power; and an active switch, only capable of resetting the controller from the inactive condition to the active condition.

8. The light-emitting device of claim 7, wherein the object is one selected from the group consisting of: a shoe, a garment, a handbag, a rucksack, and a cap.

* * * * *